United States Patent [19]

Ringel

[11] Patent Number: 4,632,036

[45] Date of Patent: Dec. 30, 1986

[54] SHAPED CHARGE

[75] Inventor: Konrad Ringel, Leinburg, Fed. Rep. of Germany

[73] Assignee: Diehl GmbH & Co., Nuremberg, Fed. Rep. of Germany

[21] Appl. No.: 723,734

[22] Filed: Apr. 16, 1985

[30] Foreign Application Priority Data

May 4, 1984 [DE] Fed. Rep. of Germany ..... 3416467

[51] Int. Cl.[4] ..... F42B 11/22

[52] U.S. Cl. ..... 102/476; 102/310

[58] Field of Search ..... 102/476, 306–310

[56] References Cited

U.S. PATENT DOCUMENTS 2,856,850 10/1958 Church et al. ..... 102/307

4,191,265 3/1980 Bosse-Platiere ..... 102/310

*Primary Examiner*—Harold J. Tudor

*Attorney, Agent, or Firm*—Scully, Scott, Murphy & Presser

[57] ABSTRACT

A shaped charge with plane side surfaces, in which a booster charge is arranged above a main explosive charge, and which extends in a longitudinal direction intermediate the side surfaces. A detonation transmitter is arranged at one end or both ends of the booster charge, of which the direction of effect of which is oriented as an extension of the longitudinal direction of the booster charge. Upon the detonation of the booster charge, the detonation transmitter becomes operative and transmits the detonation to the booster charge of an adjacent positioned shaped charge. Smaller spaces or gaps between the booster charges are thereby bridged over.

3 Claims, 3 Drawing Figures

SHAPED CHARGE

BACKGROUND OF THE INVENTION

1. Field of the Invention

The present invention relates to a shaped charge with plane side surfaces, in which a booster charge is arranged above a main explosive charge, and which booster charge extends in a longitudinal direction intermediate the side surfaces.

2. Discussion of the Prior Art

A shaped charge of the above-mentioned type is described in the specification of German Petty Patent No. 81 18 005. When such shaped charges are positioned adjoining each other for the formation of a chain or series of shaped charges, when there is encountered any uneveness of the emplacement surface, it is possible that the side surfaces of the shaped charges will not be flatly positioned against each other. As a result, spaces will be formed between the booster charges of adjacent shaped charges. Consequently, the detonation will fail to propagate across this space or separation. This is especially disadvantageous when the main explosive charge is to be detonated from above.

SUMMARY OF THE INVENTION

Accordingly, it is an object of the present invention to contemplate a shaped charge of the above-mentioned type, which is so constructed that it facilitates in the detonation of the booster charge of an adjacent shaped charge in a chain of shaped charges.

Inventively, the foregoing object is achieved in a shaped charge of the above-mentioned type in that a detonation transmitter is arranged at one end or both ends of the booster charge, of which the direction of action is oriented as an extension of the longitudinal direction of the booster charge. Upon the detonation of the booster charge, the detonation transmitter becomes operative and transmits the detonation to the booster charge of an adjacent positioned shaped charge. Smaller spaces or gaps between the booster charges are thereby bridged over.

When detonation transmitters are provided on both side surfaces, then no consideration need be given to a correct orientation of the shaped charges during the setting up of a chain of shaped charges.

In a preferred embodiment of the invention, the detonation transmitter incorporates a metallic insert which is dimensioned so as to form a projectile upon the detonation of the booster charge. Upon detonation, this projectile is then accelerated in a direction towards the booster charge of the adjacent shaped charge, and detonates the booster charge. The projectile bridges over any space which, upon occasion, may be existent between the booster charges.

In a modification of the invention, the booster charge is constituted of an explosive, whose detonation velocity is higher than that of the explosive of the main or primary explosive charge. This, in effect, will cause every main explosive charge to be detonated by the booster charge which is associated therewith and will not initiate the detonation of a neighboring main explosive charge. Otherwise, there would be lost the effect of a detonation wave guidance member which is inserted into the main explosive charge.

BRIEF DESCRIPTION OF THE DRAWINGS

Further advantageous embodiments of the invention may now be ascertained from the following detailed description of an exemplary embodiment thereof, taken in conjunction with the accompanying drawings; in which.

DETAILED DESCRIPTION

Figure 1:
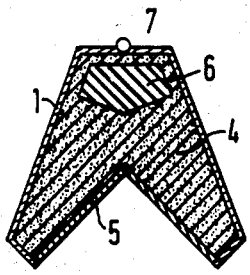
FIG. 1 illustrates a sectional view through a shaped charge taken along line I—I in FIG. 2.

A shaped charge includes a casing 1 with two oppositely located plane side surfaces 2 and 3. Arranged within the casing 1 is a main or primary explosive charge 4 which is bordered at its lower end by an insert 5. Embedded in the main explosive charge 4 is a detonation wave guidance member 6.

Above the detonation wave guidance member 6 there is an arranged a booster charge 7. This booster charge extends centrally above the detonation wave guidance member 6 from side surface 2 to the side surface 3. Detonation transmitters 8 are provided at the two ends of the booster charge 7.

Each of the detonation transmitters 8 possesses a metallic insert 10 in addition to an explosive component 9. This insert is concavely curved as viewed from externally thereof. The insert can be configured either part-cylindrically or with an angle similar to that of the insert 5. The same explosive material can be utilized for the booster charge 7 and the explosive component 9. Utilized for the booster charge 7 is an explosive whose detonation velocity is higher than the detonation velocity of the explosive employed for the main explosive charge 4.

Figure 2:
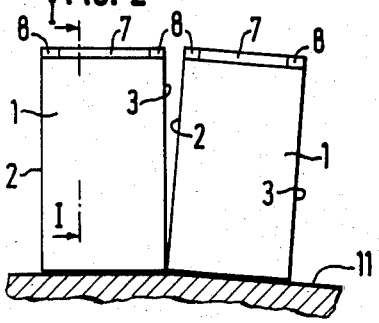
FIG. 2 illustrates a side view of two shaped charges in a chain of shaped charges.
Figure 3:
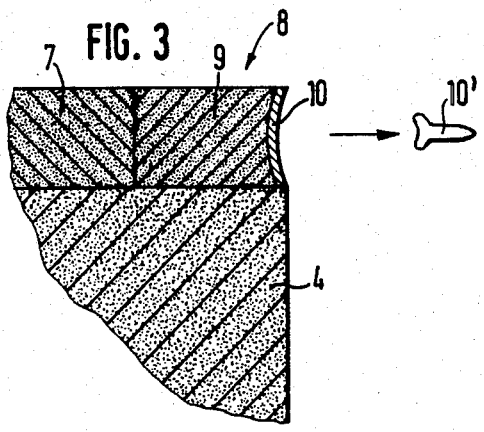
FIG. 3 illustrates, on an enlarged scale, a side view of a fragmentary portion of a shaped charge.

In the illustration pursuant to FIG. 2, two shaped charges are emplaced adjacent each other on a support surface 11. Due to an unevenness in the support or emplacement surface 11, a gap is present between the booster charges 7 of the two shaped charges.

When one of the booster charges 7 is detonated, it will then also detonate its explosive component 9, such that a projectile 10' is formed by the insert 10, which then flies towards the booster charge of the adjoining shaped charge and initiates its detonation. Since the detonation velocity of the booster charges 7 is higher than that of the main or primary explosive charges 4, there is effected the detonation of the main explosive charges from the applicable booster charge prior to the main explosive charge being detonated by the adjoining main explosive charge.

What is claimed is:

1. In a shaped charge including plane side surfaces; a booster charge arranged above a main explosive charge, said booster charge extending in the longitudinal direction between the side surfaces of said shaped charge; the improvement comprising: a detonation transmitter being positioned on at least one end of the booster charge, said detonation transmitter having the direction of action thereof oriented as an extension of the longitudinal direction of the booster charge, said detonation transmitter comprising a metallic insert configured to form a projectile upon the detonation of the booster charge, and said insert being concavely curved at the side facing away from the booster charge.

2. A shaped charge as claimed in claim 1, wherein said detonation transmitter includes an explosive component constituted of the same explosive material as that of the booster charge.

3. A shaped charge as claimed in claim 1, wherein the booster charge is constituted of an explosive material possessing a detonation velocity higher than that of the explosive material of the main explosive charge.

* * * * *